US010179464B2

(12) United States Patent
Schütz

(10) Patent No.: US 10,179,464 B2
(45) **Date of Patent: *Jan. 15, 2019**

(54) DEVICE FOR PRODUCING CUT OBJECTS

(71) Applicant: CEWE Stiftung & Co. KGaA, Oldenburg (DE)

(72) Inventor: Peter Schütz, Varel (DE)

(73) Assignee: CEWE Stiftung & Co. KGaA, Oldenburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/528,478

(22) PCT Filed: Nov. 19, 2015

(86) PCT No.: PCT/EP2015/077163

§ 371 (c)(1),
(2) Date: May 19, 2017

(87) PCT Pub. No.: WO2016/079268

PCT Pub. Date: May 26, 2016

(65) Prior Publication Data

US 2017/0253055 A1 Sep. 7, 2017

(30) Foreign Application Priority Data

Nov. 19, 2014 (DE) ..... 10 2014 223 628
Dec. 12, 2014 (DE) ..... 10 2014 225 760

(51) Int. Cl.
*B41J 11/70* (2006.01)
*B41J 11/66* (2006.01)
(Continued)

(52) U.S. Cl.
CPC ..... *B41J 11/663* (2013.01); *B26D 3/085* (2013.01); *B26D 5/32* (2013.01); *B26D 5/34* (2013.01);
(Continued)

(58) Field of Classification Search
CPC ..... B41J 11/663; B41J 3/4075; B41J 11/70; B41M 5/382; B65H 35/06;
(Continued)

(56) References Cited

U.S. PATENT DOCUMENTS 6,146,035 A * 11/2000 Ishigouoka ..... B41J 11/46 400/621
6,945,645 B2 9/2005 Baron
(Continued)

FOREIGN PATENT DOCUMENTS

CN 101516628 8/2009
CN 102285247 12/2011
(Continued)

OTHER PUBLICATIONS

International Search Report and Written Opinion of the International Searching Authority dated Feb. 25, 2016 (+English translation), in International Patent Application No. PCT/EP15/77163, 21 pages.

*Primary Examiner* — Yaovi M Ameh
(74) *Attorney, Agent, or Firm* — Ellen M. Bierman; Lowe Graham Jones PLLC

(57) ABSTRACT

The disclosure relates to a device for producing cut objects. A dye-sublimation thermal printer prints a printing pattern onto a printing substrate and outputs the latter. A cutting apparatus cuts the printing substrate along a cutting pattern, wherein the cutting apparatus comprises a cutting unit and a moving unit for moving the printing substrate during cutting. The dye-sublimation thermal printer is adapted to print the printing substrate in such a way that the outputted printing substrate has a printed area in which printing has occurred and a non-printed area in which printing has not occurred, wherein the printed area and the non-printed area are successively arranged and the dimension of the non-
(Continued)

printed area in the arrangement direction is at least equal to a distance between the cutting unit and the first moving unit.

14 Claims, 9 Drawing Sheets

(51) Int. Cl.

| | |
|---|---|
| ***B41J 3/407*** | (2006.01) |
| ***B65H 35/06*** | (2006.01) |
| ***G07B 5/02*** | (2006.01) |
| ***B26D 3/08*** | (2006.01) |
| ***B26D 5/32*** | (2006.01) |
| ***B26D 5/34*** | (2006.01) |
| ***B26F 1/38*** | (2006.01) |
| ***B41M 5/382*** | (2006.01) |
| *B26D 7/00* | (2006.01) |

(52) U.S. Cl.
CPC ..... *B26F 1/3813* (2013.01); *B41J 3/4075* (2013.01); *B41J 11/70* (2013.01); *B41M 5/382* (2013.01); *B65H 35/06* (2013.01); *G07B 5/02* (2013.01); *B26D 2007/005* (2013.01); *B65H 2403/942* (2013.01)

(58) Field of Classification Search
CPC ... B65H 2403/942; B26F 1/3813; B26D 5/34; B26D 5/32; B26D 3/085; B26D 2007/005; G07B 5/02
See application file for complete search history.

(56) References Cited

U.S. PATENT DOCUMENTS

| | | | | |
|---|---|---|---|---|
| 2005/0212889 | A1 | 9/2005 | Kitamura et al. | |
| 2005/0212890 | A1 | 9/2005 | Kitamura et al. | |
| 2013/0149019 | A1* | 6/2013 | Sugimura ..... | B41J 11/42 400/621 |
| 2014/0085394 | A1 | 3/2014 | Mindler et al. | |
| 2014/0126947 | A1 | 5/2014 | Sago et al. | |
| 2017/0252938 | A1* | 9/2017 | Schutz ..... | B26D 5/32 |

FOREIGN PATENT DOCUMENTS

| | | |
|---|---|---|
| CN | 103158368 | 6/2013 |
| DE | 69901750 | 12/2002 |
| JP | H02196278 | 8/1990 |
| JP | 11-277826 | 10/1999 |
| JP | 11-320993 | 11/1999 |
| JP | 2000187775 | 7/2000 |
| JP | 2007-022070 | 2/2007 |
| JP | 4443760 | 3/2010 |
| JP | 2010-274353 | 12/2010 |

* cited by examiner

DEVICE FOR PRODUCING CUT OBJECTS

CROSS-REFERENCE TO RELATED APPLICATIONS

This application is a U.S. national phase of International Patent Application No. PCT/EP2015/077163 filed Nov. 19, 2015, which claims priority from Germany Patent Application Nos. 102014225760.3 filed Dec. 12, 2014 and 102014223628.2 filed Nov. 19, 2014, the contents of which applications are hereby incorporated by reference in their entireties.

TECHNICAL FIELD

The invention relates to a device, a method and a computer program for producing cut objects. The invention also relates to a dye-sublimation thermal printer for use in the device for producing cut objects.

BACKGROUND

Printing patterns onto a printing substrate, such as a paper substrate, by means of a dye-sublimation thermal printer and then cutting out the printing pattern by means of a cutting apparatus, such as an X/Y cutting machine, in order to produce cut objects is known in the art. The consumption of printing materials can be relatively high when producing objects in this way.

BRIEF DESCRIPTION OF THE DRAWINGS

Embodiments of the invention shall now be described with reference to the attached Figures, in which.

DETAILED DESCRIPTION

Figure 1:
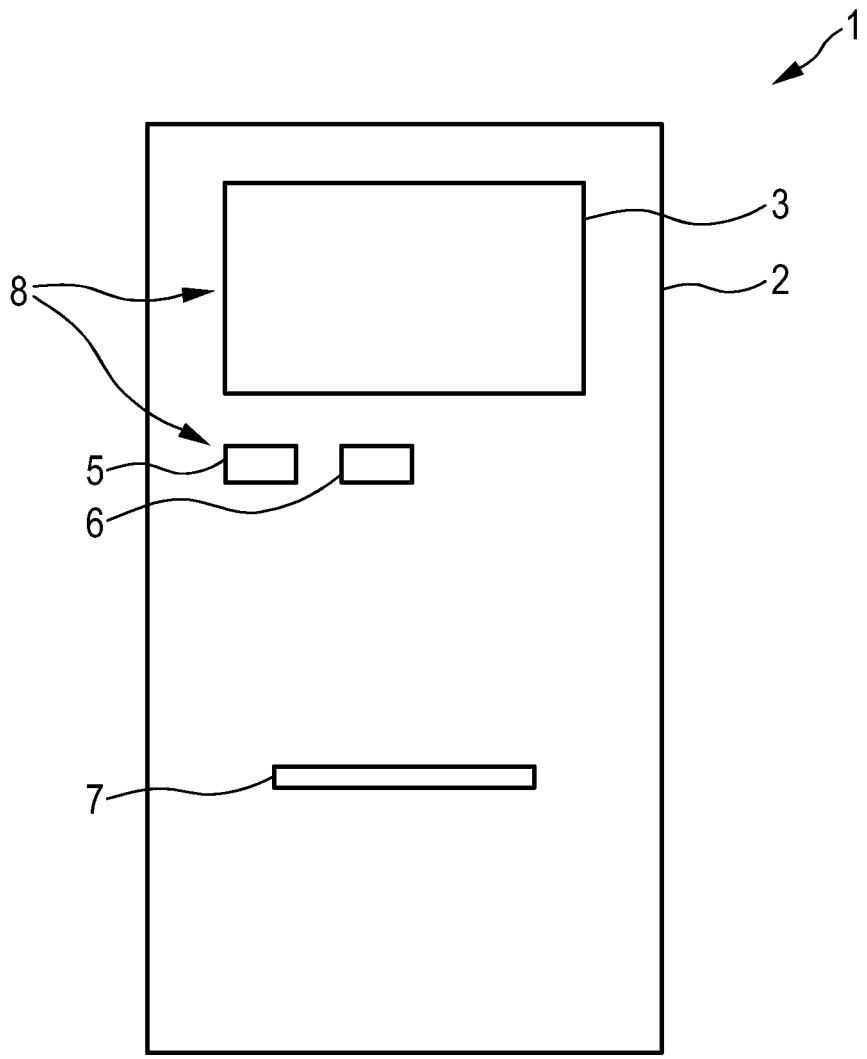
FIG. 1 shows, in schematic form and by way of example, an embodiment of a device for producing cut objects.

Embodiments described herein provide a device, a method and a computer program for producing cut objects, which can reduce the amount of printing materials consumed. Some embodiments provide a dye-sublimation thermal printer for use in the device for producing cut objects and which can reduce the amount of printing materials consumed.

This goal is achieved by a device for producing cut objects, comprising the following components:

a dye-sublimation thermal printer for printing the pattern onto a printing substrate and for outputting the printed printing substrate, a cutting apparatus for cutting the printing substrate along the cutting pattern, wherein the cutting apparatus has a cutting unit for cutting the printing substrate and a first moving unit for moving the printing substrate within the cutting apparatus, wherein the first moving unit is adapted to move the printing substrate during the cutting process in a direction of movement from the first moving unit to the cutting unit and back from the cutting unit to the first moving unit, wherein the dye-sublimation thermal printer is adapted to print the printing substrate in such a way that the outputted printing substrate has a printed area in which printing has occurred and a non-printed area in which printing has not occurred, wherein the printed area and the non-printed area are successively arranged and the dimension of the non-printed area in the arrangement direction is at least equal to a distance between the cutting unit and the first moving unit.

Since not all of the outputted printing substrate is printed upon, but only the printed area, it is possible to reduce the consumption of printing materials. Furthermore, due to the dimensions of the non-printed area of the outputted printing substrate in the arrangement direction being at least equal to the distance between the first moving unit and the cutting unit, and because cutting in an area inside the cutting apparatus between the first moving unit and the cutting unit is generally technically complex or even impossible, producing the printed printing substrate by means of the dye-sublimation thermal printer in such a way that it has a printed area and a non-printed area can reduce the consumption of printing materials without adversely affecting the production process.

In one embodiment, the dimensions of the non-printed area in the arrangement direction are equal to the distance between the cutting unit and the first moving unit. In another embodiment, the dimensions of the non-printed area in the arrangement direction are only slightly greater than the distance between the cutting unit and the first moving unit. For example, the dimensions of the non-printed area in the arrangement direction may be no more than 1 mm, 5 mm, 10 mm, 15 mm or 20 mm greater than the distance between the cutting unit and the first moving unit.

The device may be adapted to produce adhesive labels as cut objects, and the printing substrate can be an adhesive film which can be peeled off a substrate material, for example from a paper substrate. The cutting apparatus may be adapted to cut the adhesive film only along the cutting pattern, and not the substrate material underneath it, in order to produce the cut object. After the cut object has been produced, the cut-around part of the adhesive film, that is, the cut object, can be peel off. The device may also be adapted to produce other cut objects, for example non-stick cut-out paper objects.

The dye-sublimation thermal printer and the cutting apparatus are preferably arranged in such a way that the direction of movement and the arrangement direction are aligned. The device preferably also comprises a) a transferring apparatus for automatically transferring the printed printing substrate from the dye-sublimation thermal printer to the cutting apparatus, wherein the transferring apparatus comprises a second moving unit for automatically moving the printed printing substrate in a forward direction from the dye-sublimation thermal printer to the cutting apparatus, wherein the forward direction is aligned with the direction of movement and the arrangement direction, and b) a control apparatus for controlling at least the transferring apparatus and the cutting apparatus.

Thus, the device preferably comprises a dye-sublimation thermal printer, a transferring apparatus and a cutting apparatus, wherein the printer prints onto the printing substrate and outputs the printed printing substrate, after which the transferring apparatus guides the outputted printing substrate automatically to the cutting apparatus, in which the printing substrate is cut along the cutting pattern to produce the cut object. Since the orientation of the printing substrate inside the cutting apparatus is known, due to the printed printing substrate being transferred automatically from the printer to the cutting apparatus, manual adjustment of the printing substrate inside the cutting apparatus is not absolutely necessary, which can result in reduced susceptibility to error, that is, in less likelihood of inaccurate cuts, and thus in cut objects of better quality.

The dye-sublimation thermal printer and the cutting apparatus are preferably units that are spaced apart from each other. The cutting apparatus is preferably not integrated in the dye-sublimation thermal printer integrated, and vice versa. The transferring apparatus is preferably arranged between the dye-sublimation thermal printer and the cutting apparatus. The transferring apparatus is preferably integrated with neither the dye-sublimation thermal printer nor the cutting apparatus.

The dye-sublimation thermal printer, the transferring apparatus and the cutting apparatus are preferably arranged in such a way that the printing substrate can be moved linearly in a forward direction from the dye-sublimation thermal printer to the cutting apparatus via the transferring apparatus, wherein the transferring apparatus is adapted to move the printed printing substrate in a forward direction by performing a translational movement only, without rotating the printing substrate, which is an adhesive film, in particular. Since the transferring apparatus moves the printed printing substrate by performing a translational movement only, without rotating the printing substrate, the likelihood of incorrect adjustment of the printed printing substrate within the cutting apparatus and therefore of inaccurate cuts is further reduced. In order to further improve this cutting accuracy, the pattern can be provided with an orientation marking so that the printed printing substrate has an orientation marking, the cutting apparatus having a detection unit for detecting the orientation marking on the printed printing substrate, and may be adapted to optimize the orientation of the printed printing substrate inside the cutting apparatus, on the basis of the detected orientation marking, before cutting is carried out. In particular, the first moving unit of the cutting apparatus for moving the printed printing substrate inside the cutting apparatus in a backward and forward direction, and the cutting unit, which can be moved laterally in relation thereto and in particular orthogonally in relation thereto, can be controlled in such a way that, before cutting is carried out, the position of the cutting unit relative to the orientation marking corresponds even better to a predefined position. In this way, the cutting accuracy can be further improved.

Due to the printed printing substrate preferably being fed automatically and relatively accurately from the dye-sublimation thermal printer to the cutting apparatus in the defined manner, automatic repositioning based on a plurality of orientation markings on the printed printing substrate does not generally provide any further advantage as far as accuracy is concerned. For that reason, such repositioning is carried out in a preferred embodiment purely on the basis of a single orientation marking. Several orientation markings could be used in other embodiments, however, or repositioning could be omitted, in which case the printed printing substrate could have no orientation marking. The orientation marking preferably comprises an L-shaped structure which is preferably arranged in a corner area of the printed printing substrate.

The detection unit may have a light source, in particular a laser, for irradiating the printed printing substrate, and a detector for detecting the light reflected from the printed printing substrate, wherein the detection unit may be adapted to detect the orientation marking on the basis of the reflected light, and wherein the control apparatus may be adapted not to activate the laser until the first moving unit is activated. In this way, the energy consumption of the apparatus can be reduced.

The control unit is preferably configured to control the first moving unit and the cutting unit so that the printed printing substrate and the cutting unit are moved in such a way that the adhesive film is cut along the cutting pattern.

The control apparatus is preferably adapted to control the first and the second moving units in such a way that only the second moving unit is initially activated to move the printed printing substrate to the first moving unit, wherein both moving units are then activated in such a way that the two moving units synchronously move the printed printing substrate further into the cutting apparatus. More particularly, the printed printing substrate is moved to a short distance in front of the first moving unit, and it is not until then that the two moving units are moved synchronously in order to guide the printed printing substrate into the cutting apparatus. Due to the second moving unit initially moving the printed printing substrate to a short distance in front of the first moving unit, and to the fact that it is not until that state has been reached, in which the printed printing substrate is located a short distance in front of the first moving unit, that both the moving units are moved synchronously to guide the printed printing substrate into the cutting apparatus, it is possible to prevent the second moving unit from pressing the printed printing substrate against the first moving unit, as a result of which it is possible to prevent the printed printing substrate from being curled, folded and/or twisted. Since the first moving unit is also activated only when the state described above has been reached, in which the printed printing substrate is located directly in front of the first moving unit, the first moving unit is not activated unnecessarily, with the result that energy consumption can be reduced.

It is preferable that the transferring apparatus also comprises a measurement unit for measuring the distance the printed printing substrate is moved in the direction of the cutting apparatus by means of the second moving unit, the control apparatus being adapted to control the second moving unit in such a way that the printed printing substrate is moved forward in the direction of the cutting apparatus until the measured distance indicates that the printed printing substrate has been moved to the first moving unit. By using the measurement unit, it is possible to ensure by relatively simple technical means that the second moving unit initially moves the printed printing substrate only as far as a short distance in front of the first moving unit.

The measurement unit is also preferably adapted to measure the distance that the dye-sublimation thermal printer has guided the printed printing substrate into the transferring apparatus, wherein the control apparatus is adapted to control the second moving unit in such a way that the printed printing substrate is moved forward in the direction of the cutting apparatus until the total measured distance indicates that the printed printing substrate has been moved to the first moving unit. By additionally taking into account the distance which the dye-sublimation thermal printer has guided the printed printing substrate into the transferring apparatus, it is possible for the printed printing substrate to be moved even more accurately by means of the second moving unit such that the printed printing substrate is initially only moved as far as a short distance in front of the first moving unit.

The second moving unit preferably has motor-driven rolls that freewheel in a forward direction, the measurement unit being adapted to measure a passive freewheeling rotation of the rolls when the printed printing substrate is moved from the dye-sublimation thermal printer into the transferring apparatus, in order to measure the distance that the dye-sublimation thermal printer has moved the printed printing substrate into the transferring apparatus. Since the second moving unit has motor-driven rolls that freewheel in the forward direction, the dye-sublimation thermal printer can move the printed printing substrate into the second moving unit, that is, to the motor-driven rolls of the second moving unit, without running the risk of the printed printing substrate being curled, folded and/or twisted. This further reduces the likelihood of the printed printing substrate being imprecisely aligned in the cutting apparatus, and hence of it being inaccurately cut. Measuring distance on the basis of rotation can also be used to measure the distance by which the second moving unit has moved the printed printing substrate in the direction of the cutting apparatus. This allows the device to be more compact in design.

The first moving unit preferably comprises motor-driven rolls for moving the printed printing substrate into the cutting apparatus, wherein the motor-driven rolls do not freewheel. The transferring apparatus also preferably comprises a guide unit which is adjusted to guide the printed printing substrate past the second moving unit when the first moving unit moves the printed printing substrate backward in the direction of the transferring apparatus. The guide unit is adjusted, in particular, to guide the printed printing substrate underneath the second moving unit when the first moving unit moves the printed printing substrate backward in the direction of the transferring apparatus. By guiding the printed printing substrate past the second moving unit, it is possible to ensure that the printed printing substrate is not curled, folded and/or twisted when it is being cut in the cutting apparatus, while the printed printing substrate is generally being moved backward in the direction of the second moving unit. In this way, it is also possible to ensure that the printed printing substrate also remains exactly aligned during the cutting operation inside the cutting apparatus, as a result of which the cutting accuracy can be improved still further.

The transferring apparatus may have an printing substrate detection unit for detecting when the printed printing substrate is fed to the transferring apparatus, wherein the control apparatus can be adapted to control the second moving unit in such a way that the second moving unit does not move the printed printing substrate in the direction of the cutting apparatus until a predefined period of time has expired since detection of the printing substrate being fed. The dye-sublimation thermal printer is preferably adapted to provide the printed area und the non-printed area on a portion to be cut off from a web of printing substrate, wherein the printing pattern is printed onto the printed area and the non-printed area is not printed on, and wherein the dye-sublimation thermal printer cuts off said portion and outputs the cut-off portion as a printed printing substrate. The predefined period of time is preferably at least so long that the cutting operation of the dye-sublimation thermal printer is completed when the second moving unit begins to move the outputted and printed printing substrate in the direction of the cutting apparatus. In this way, it is possible to prevent the second moving unit from already trying to move the printed printing substrate to the first moving unit, for example, even though the web of printing substrate has not yet been cut and the dye-sublimation thermal printer has not yet released the printed printing substrate. The printed printing substrate can be prevented, for example, from moving inadvertently and in particular from being twisted, which could ultimately result in the printed printing substrate being imprecisely aligned within the cutting apparatus and thus in the cutting operation being less accurate.

In one embodiment, the second moving unit preferably comprises motor-driven rolls for moving the printing substrate, which is an adhesive film, in particular, wherein the motor-driven rolls can freewheel in the direction of the cutting apparatus.

The dye-sublimation thermal printer and the transferring apparatus are preferably adapted in such a way that the printed printing substrate fed to the transferring apparatus from the dye-sublimation thermal printer rotates the freewheeling rolls of the second moving unit, wherein the printing substrate detection unit is adapted to detect when the printing substrate is fed, by detecting the rotation of the rolls of the second moving unit. This passive rotation of the freewheeling rolls can additionally be used, in particular, to measure the distance that the printed printing substrate has been guided into the transferring apparatus by the dye-sublimation thermal printer. The rolls of the second moving unit may thus be used for different purposes, thus allowing the device to be very compact in design.

The printing pattern is preferably a color and/or black and white and/or grayscale pattern. The device may have an input device which is adapted to allow a user to enter inputs, and a pattern generating means for generating the pattern on the basis of said user inputs, wherein the pattern comprises the cutting pattern and the printing pattern within the cutting pattern. However, the pattern may also be predefined in some other way. The input device preferably comprises a photo data receiving unit, said photo data receiving unit being adapted to receive the user's photo data as user input. The input device is preferably also adapted to show the user different pattern templates and to allow the user to select a pattern template as user input. The input device is preferably also adapted to allow a user to select a product, in particular a product bought in a self-service area of a drug store, wherein the input device can be further adapted to select a pattern template on the basis of the selected product and on the basis of predefined allocations between products and patterns, and to provide the selected pattern template as user input. More particularly, the products may be marked with a product code, and the input device may comprise a product code reader for reading a product code of a product selected by the user. The product code can be a barcode, for example, and the product code reader can be a unit for reading a barcode. The input device can also be adapted to allow the user to enter inputs which modify the selected pattern template, for example the user can enter a text and/or a color to be added to the pattern. The photo data can also be added to the pattern.

The input device, the pattern generating means, the dye-sublimation thermal printer, the transferring apparatus and the cutting apparatus are preferably also integrated in the same device for producing cut objects. A user can therefore input data directly in a self-service area of a drug store, for example, after which the pattern generating means generates the pattern on the basis of the user inputs, the dye-sublimation thermal printer prints the generated pattern onto the printing substrate, the printed printing substrate is guided automatically by means of the transferring apparatus to the cutting apparatus and the cutting apparatus cuts the printing substrate along the cutting pattern to produce the cut object directly in the self-service area. The device can therefore produce a personalized cut object in a relatively fast process using user inputs.

The goal specified above can also be achieved by a dye-sublimation thermal printer for using as part of the device for producing cut objects according to claim 1, the dye-sublimation thermal printer being adapted to print a printing pattern on a printing substrate and to output the printed printing substrate, wherein the dye-sublimation thermal printer is adapted to print the printing substrate in such a way that the outputted printing substrate comprises a printed area in which printing has occurred and a non-printed area in which printing has not occurred.

The goal specified above is also achieved by a method for producing cut objects, said method comprising the following steps:

printing the printing pattern onto a printing substrate and outputting the printed printing substrate by means of a dye-sublimation thermal printer, cutting the printing substrate along the cutting pattern by means of a cutting apparatus, wherein the cutting apparatus has a cutting unit for cutting the printing substrate and a first moving unit for moving the printing substrate within the cutting apparatus, wherein the first moving unit moves the printing substrate during a cutting operation into a direction of movement from the first moving unit to the cutting unit and/or back from the cutting unit to the first moving unit, wherein the dye-sublimation thermal printer prints onto the printing substrate in such a way that the outputted printing substrate has a printed area in which printing has occurred and a non-printed area in which printing has not occurred, wherein the printed area and the non-printed area are successively arranged and the dimension of the non-printed area in the arrangement direction is at least equal to a distance between the cutting unit and the first moving unit.

The goal specified above is also achieved by a computer program for producing cut objects, wherein the computer program contains program code which is adapted to control a device for producing cut objects as described herein in such a way that a method for producing cut objects as described herein is carried out when the computer program is executed on a control apparatus which controls the device.

It should be understood that the herein-described device, dye-sublimation thermal printer, method and computer program have similar and/or identical preferred embodiments, as defined in particular in the dependent claims.

Figure 2:
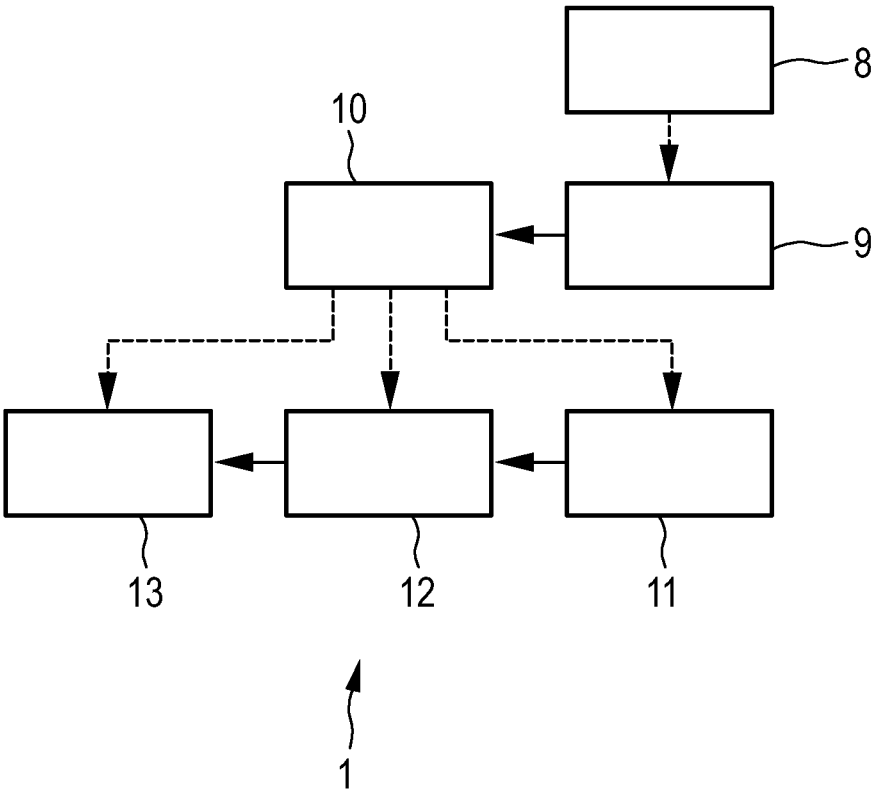
FIG. 2 shows, in schematic form and by way of example, some components of the device shown in FIG. 1.
Figure 3:
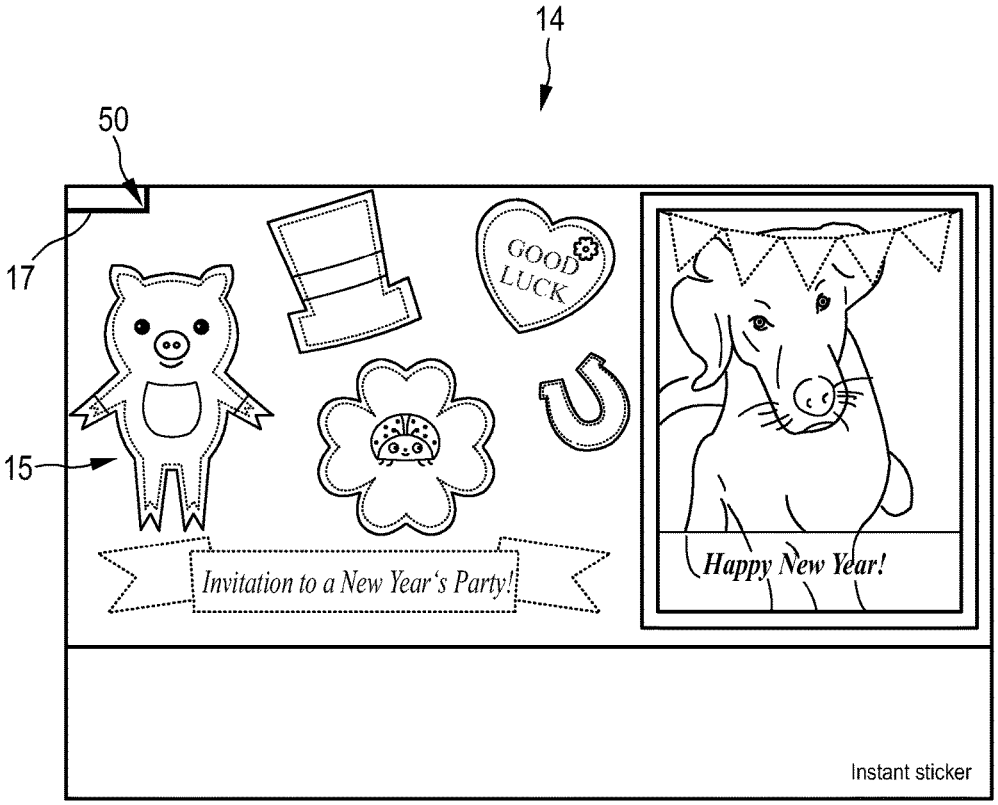
FIG. 3 shows, in schematic form and by way of example, a printed and cut adhesive film containing several adhesive labels thus produced as cut objects.

FIG. 1 shows, in schematic form and by of example, an embodiment of a device for producing cut objects, which in this embodiment are adhesive labels. In this example, device 1 is in a self-service area of a drug store. Device 1 comprises a touch-sensitive monitor 3, a photo data receiving unit 5 and a product code reader 6 in a housing 2. Touch-sensitive monitor 3, photo data receiving unit 5 and product code reader 6 may be conceived of as components of an input device 8 which is adapted to allow a user to enter inputs. Inside housing 2, there is also a pattern generating means 9 for generating a pattern 15 on the basis of the user inputs, wherein pattern 15 comprises a cutting pattern and a printing pattern within the cutting pattern. FIG. 2 illustrates, in schematic form and by way of example, the pattern generating means 9 and other components of device 1 that are located inside housing 2. FIG. 3 shows an example of a printed and cut printing 14 containing several patterns 15, and which in this embodiment is an adhesive film.

Photo data receiving unit 5 is adapted to receive the user's photo data as user inputs. The user can also select a product that is obtainable in the self-service area of the drug store and hold it up to product code reader 6 so that a product code applied to the product can be read by product code reader 6. The product code can be a barcode, for example, and product code reader 6 can be a unit for reading a barcode. Input device 8 can also have allocations between products or product codes, on the one hand, and pattern templates, on the other hand, and one or more pattern templates can be shown on touch-sensitive monitor 3 on the basis of these allocations and the product code which is read from the product selected by the user. When several pattern templates are displayed on touch-sensitive monitor 3, the user can select one of them. Input device 8 can also be adapted to allow the user to enter desired changes, for example a desired text, a desired color, etc. On the basis of those user inputs, pattern generating means 9 can generate the pattern.

Device 1 further comprises a dye-sublimation thermal printer 11 for printing a printing pattern onto an adhesive film 14, a cutting apparatus 13 for cutting adhesive film 14 along a cutting pattern, and a transferring apparatus 12 for automatically transferring printed printing substrate 14 from dye-sublimation thermal printer 11 to cutting apparatus 13, wherein transferring apparatus 12 comprises a second moving unit 16 for automatically moving printed printing substrate 14 in a forward direction from dye-sublimation thermal printer 11 to cutting apparatus 13. Device 1 further comprises a control apparatus 10 which is adapted to control the automatic transfer of printed printing substrate 14 from dye-sublimation thermal printer 11 to cutting apparatus 13.

The printing pattern is preferably a color and/or black and white and/or grayscale pattern. The dye-sublimation thermal printer is adapted to provide a printed area 55 und a non-printed area on a portion to be cut off from a web of printing substrate, which in this example is a web of adhesive film, wherein the printing pattern is printed onto the printed area 55 and the non-printed area 56 is not printed on, and wherein the dye-sublimation thermal printer 11 cuts off said portion and outputs the cut-off portion as a printed printing substrate, which in this example is a printed adhesive film 14.

Dye-sublimation thermal printer 11 and transferring apparatus 12 are adapted and arranged so that, when the printed and cut adhesive film 14 is outputted, it is fed from the dye-sublimation thermal printer 11 to transferring apparatus 12. Dye-sublimation printer 11, transferring apparatus 12 and cutting apparatus 13 are arranged in such a way that adhesive film 14 can be moved linearly in a forward direction from dye-sublimation thermal printer 11 to cutting apparatus 13 via transferring apparatus 12, transferring apparatus 12 being adapted to move printed printing substrate 14 in a forward direction by performing a translational movement only, without rotating adhesive film 14. The adhesive film 14 printed by dye-sublimation thermal printer 11 and cut by cutting apparatus 13 is then guided out of housing 2 through an output slot 7.

Figure 4:
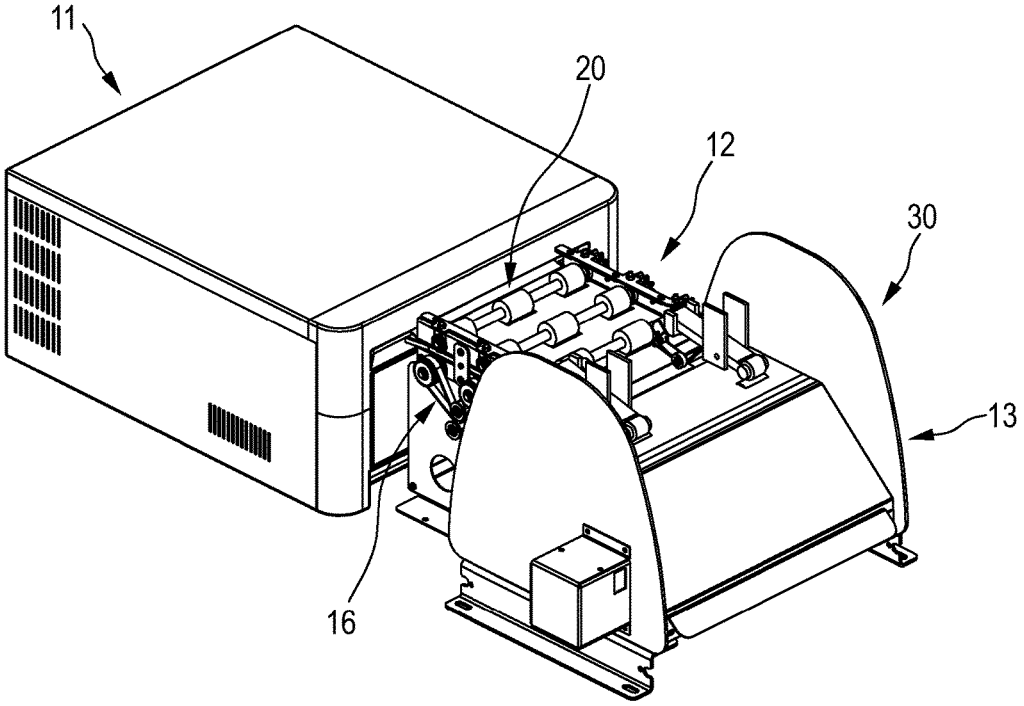
FIGS. 4-7 show, in schematic form and by way of example, different views of a combination of dye-sublimation thermal printer, transferring apparatus and cutting apparatus of the device shown in FIG. 1.
Figure 5:
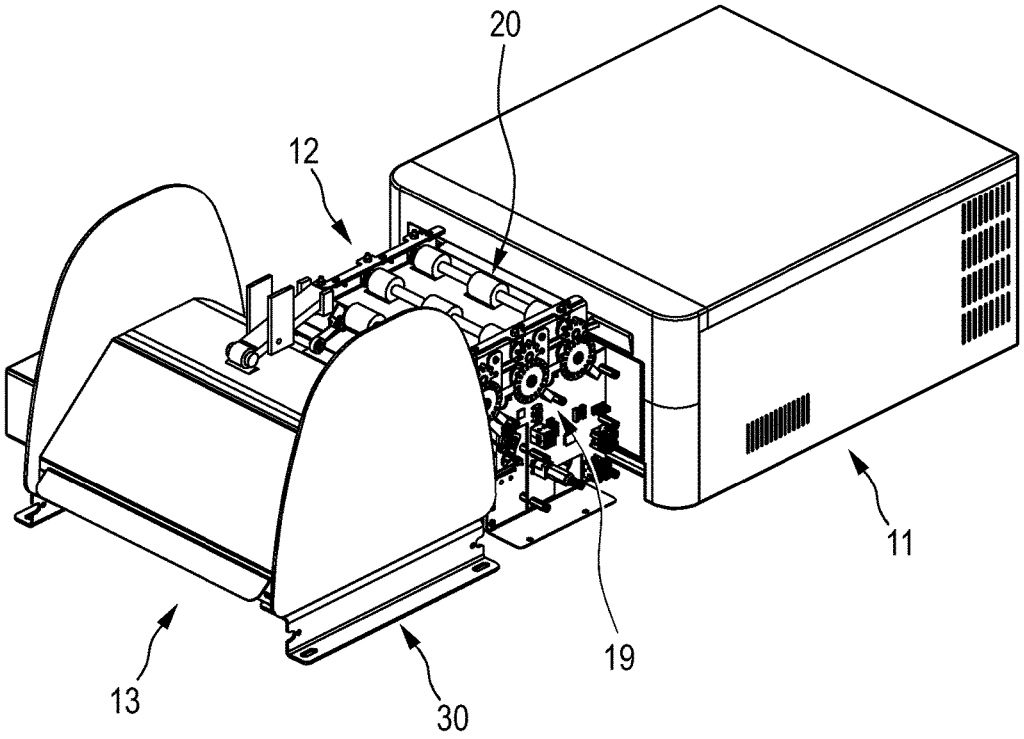
Figure 6:
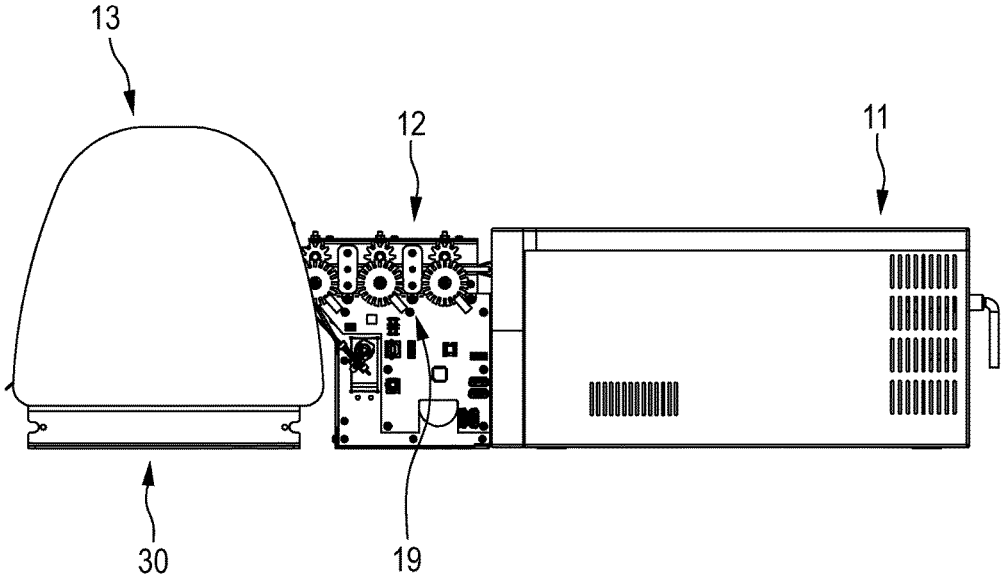
Figure 7:
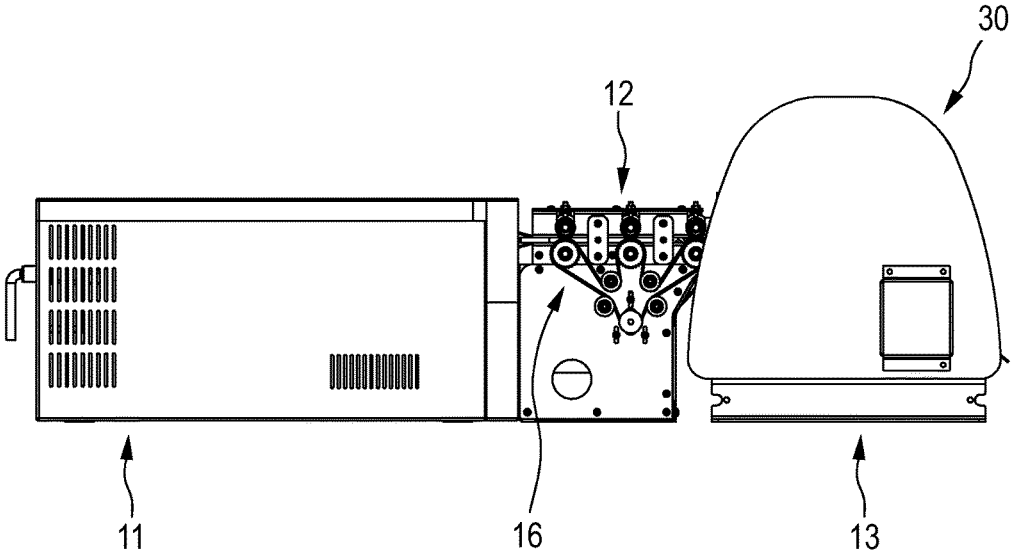
Figure 8:
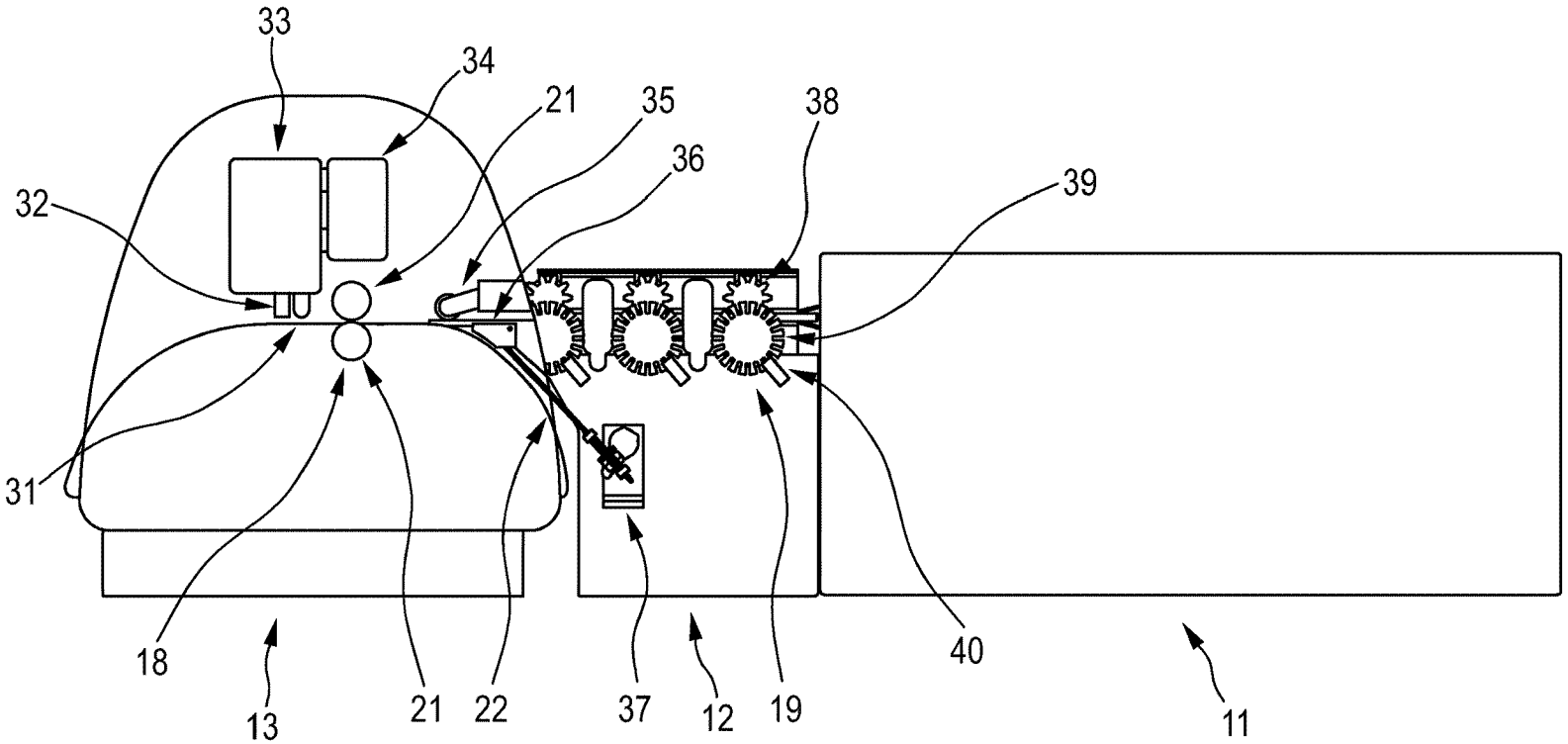
FIG. 8 shows, in schematic form and by way of example, an abstract representation of the combination shown in FIGS. 4 to 7.

In the following, details of dye-sublimation thermal printer 11, transferring apparatus 12 and cutting apparatus 13 shall be described with reference to FIGS. 4 to 8, in which FIGS. 4 and 5 show top views from an angle and FIGS. 6 and 7 show side views. FIG. 8 is an abstract representation that also shows elements of cutting apparatus 13 that are not visible in FIGS. 4 to 7 because they are arranged inside a housing 30.

The second moving unit 16 of transferring apparatus 12 comprises a plurality of rolls 20 arranged on axles, the axles being driven via a belt by means of a motor. At least those rolls 20 which are arranged on the axle closest to dye-sublimation thermal printer 11 can freewheel in the direction of forward motion of printed adhesive film 14. One end of each of the axles of the second moving unit 16, on which rolls 20 are arranged, has a sprocket 38 which engages with another sprocket 39 so that sprocket 39 turns when the axles and thus rolls 20 are driven by the motor of the second moving unit 16. Sprocket 39 turns even when the axles of the second moving unit 16 with rolls 20 are not driven motorically, but when said axles rotate due to printed adhesive film 14 being moved from dye-sublimation thermal printer 11 into transferring apparatus 12.

The second moving unit 16 further comprises a sensor 40 consisting, for example, of a combination of a light source and a light detector, the light source and the light detector being arranged in such a way that the number of teeth on sprocket 39 that are moved past sensor 40 can be counted. Based on the number of teeth of sprocket 39 that are moved past the sensor, it is possible for control apparatus 10 to determine by how many degrees sprocket 39 has been turned. This can be used to measure the distance by which printed printing substrate 14 has been moved through dye-sublimation printer 11 into transferring apparatus 12 and also by means of the second moving unit 16 in the direction of cutting unit 13.

Detection of any rotation of sprocket 39, which is arranged closest to dye-sublimation thermal printer 11, can be used to establish whether printed printing substrate 14 has been fed into transferring apparatus 12. The combination of sprockets 38, 39 and sensor 40 can therefore be conceived of as an adhesive film detection unit 19 for detecting when printed printing substrate 14 is fed to transferring apparatus 12. Since the combination of sprockets 38, 39 and sensor 40 is also used to measure the distance by which dye-sublimation thermal printer 11 has guided printed adhesive film 14 into transferring apparatus 12 and by which the second moving unit 16 has moved printed adhesive film 14 in the direction of cutting apparatus 13, this combination can also be conceived of as a measurement unit 19 for measuring said distances.

The second moving unit 16 is preferably controlled in such a way that the second moving unit 16 does not move printed adhesive film 14 in the direction of cutting apparatus 13 until a predefined period of time has expired since detection of the adhesive film 14 being fed. The predefined period of time is preferably at least so long that the cutting operation of dye-sublimation thermal printer 11 is completed when the second moving unit 16 begins to move printed adhesive film 14 in the direction of cutting apparatus 13.

Control apparatus 10 is preferably adapted so that the second moving unit 16 moves printed adhesive film 14 forward in the direction of cutting apparatus 13 until the measured distance indicates that printed adhesive film 14 has been moved to a first moving unit 18 of cutting apparatus 13. The second moving unit 16 is specifically controlled so that printed adhesive film 14 is moved forward in the direction of cutting apparatus 13 until the measured distance indicates that printed adhesive film 14 is arranged just in front of rolls 21 of the first moving unit 18. The rolls 21 of the first moving unit 18 are motor-driven and do not freewheel. They can be rotated in such a way that printed adhesive film 14 can be moved in a forward direction and in a backward direction inside cutting apparatus 13.

The first and the second moving units 18, 16 are preferably controlled in such a way that only the second moving unit 16 is initially activated to move printed adhesive film 14 to the first moving unit 18, wherein both moving units 18, 16 are then activated in such a way that the two moving units 18, 16 move printed adhesive film 14 synchronously further into cutting apparatus 13. When printed adhesive film 14 has been moved into cutting apparatus 13 and has left transferring apparatus 12, a guide unit 22 of transferring apparatus 12 is actuated so that printed adhesive film 14 is moved past the second moving unit 16 when printed adhesive film 14 is moved backward again from the first moving unit 18 of cutting apparatus 13. More particularly, guide unit 22 can be adjusted so that printed adhesive film 14 is guided underneath the second moving unit 16 when the first moving unit 18 moves printed adhesive film 14 backward in the direction of transferring apparatus 12. In this embodiment, guide unit 22 includes a guide 36 and a servodrive 37, said servodrive 37 being controlled in such a way that guide 36, which is formed by a sheet of metal, for example, is raised to guide printed adhesive film 14 past the second moving unit 16 when printed adhesive film 14 is moved backward from cutting apparatus 13.

When the adhesive film 14 is moving from transferring apparatus 12 to cutting apparatus 13, a pressure roll 35 can be used to hold adhesive film 14 down, wherein said pressure roll 35 can be designed in such a way that pressure roll 35 is pivoted upwards when servodrive 37 raises guide 36.

Printed adhesive film 14 has an orientation marking 17 which was printed onto adhesive film 14 by dye-sublimation thermal printer 11. Cutting apparatus 13 includes a detection unit 32 for detecting the orientation marking on printed adhesive film 14, said cutting apparatus 13 being adapted to optimize the orientation of printed adhesive film 14 inside cutting apparatus 13, on the basis of the detected orientation marking 17 , before cutting is carried out. More particularly, the first moving unit 18 for moving printed adhesive film 14 in a forward and a backward direction inside cutting apparatus 13, and a cutting unit 31 of cutting apparatus 13, which can be moved orthogonally in relation thereto, can be controlled in such a way that, before cutting is carried out, the position of the cutting unit relative to the orientation marking corresponds very accurately to a predefined position.

In this embodiment, both cutting unit 31 and detection unit 32 are mounted on a same head 33 of cutting apparatus 13, wherein said head 33 can be moved orthogonally to the forward and the backward direction along an axis 34 by means of a motor. The first moving unit 18 moves printed adhesive film 14, and head 33 moves detection unit 32 in such a way that detection unit 32 is arranged above the inside corner 50 of orientation marking 17. Detection unit 32, in particular, includes a light source, for example a laser, and a light detector, for example a photodiode, wherein the first moving unit 18 moves printed adhesive film 14 in such a way, and head 33 with detection unit 32 is moved in such a way, that a beam of light emitted from the light source of detection unit 32 strikes the inside corner inside corner 50 of orientation marking 17. When this state is reached, cutting unit 31 has a defined, very exact orientation relative to printed adhesive film 14, in particular to the printing pattern. After that, cutting apparatus 13 is controlled so that adhesive film 14 is cut along the cutting pattern of the respective pattern 15, adhesive film 14 being on a substrate, in particular on a paper substrate or on some other substrate medium, and cutting apparatus 13 is preferably adapted to cut through only adhesive film 14, but not the substrate underneath it. The adhesive labels produced by printing and cutting can then be outputted through output slot 7. The user can peel an adhesive label from the adhesive film 14 that has been printed and cut and can stick the label onto the desired product.

The dye-sublimation thermal printer is preferably adapted so that printed area 55 and non-printed area 56 are successively arranged in an arrangement direction 57 and the dimension 59 of non-printed area 56 in arrangement direction 57 is at least equal to a distance 54 between cutting unit 31 and the first moving unit 18 in the direction of movement 53, that is, in the forward or backward direction. Dimension 59 is thus greater than or equal to distance 54. Distance 54 can be, for example, the distance in direction of movement 53 between a) the point of contact where the first moving unit 18 is in contact with adhesive film 14 and which is closest to cutting unit 31, and b) the cutting location where cutting unit 31 cuts. If the first moving unit 18 touches adhesive film 14 at one place only in order to move the latter, distance 54 is simply the distance between said point of contact and the cutting location in direction of movement 53.

Dye-sublimation thermal printer 11 can be adapted to that the printed and non-printed areas are predefined and fixed. However, dye-sublimation thermal printer 11 can also be adapted so that the printed and non-printed areas are variable, in particular adjustable. Dye-sublimation thermal printer 11 is preferably adapted so that the dimensions of the printed area and of the non-printed area in the arrangement direction are adjustable. The printed and non-printed areas can be manually adjusted, in particular by means of a respective interface of the dye-sublimation thermal printer, or controlled by some other unit.

Figure 9:
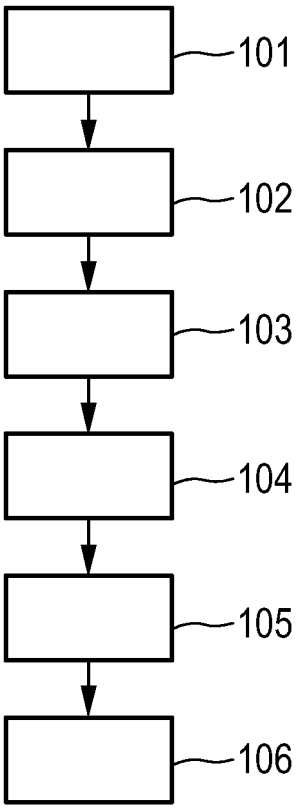
FIG. 9 shows a flow diagram illustrating an embodiment of a method for producing cut objects.

An embodiment of a method for producing cut objects, which in this embodiment are adhesive labels, in particular in a self-service area, for example of a drug store, shall now be described with reference to a flow diagram that is shown in FIG. 9.

In step 101, a user can enter inputs to input device 8. The user can enter photo data, texts, desired colors, etc., for example. The user can also select a desired pattern template from a number of such pattern templates, for example. This selection can also be made by selecting a product, with the user firstly selecting a product, after which the user can be shown one or more pattern templates that match the selected product. If the user is shown several pattern templates, the user can select one of those pattern templates by means of input device 8.

In step 102, a pattern is generated by pattern generating means 9 on the basis of the user inputs, said pattern comprising a cutting pattern and a printing pattern within the cutting pattern. For example, a photo of the user, included in the photo data, is integrated into a pattern template, and the pattern template can also be modified with colors and/or text entered by the user in step 101. The pattern thus generation, that is at least the printing pattern, is sent to dye-sublimation thermal printer 11.

In step 103, dye-sublimation thermal printer 11 prints the printing pattern onto an adhesive film 14 and outputs the printed adhesive film 14, wherein dye-sublimation printer 11 prints onto adhesive film 14 in such a way that the outputted adhesive film 14 has printed area 55 in which printing has occurred and non-printed area 56 in which printing has not occurred, wherein printed area 55 and non-printed area 57 are successively arranged in the arrangement direction 57 and dimension 59 of the non-printed area 57 in the arrangement direction 54 is at least equal to a distance 54 between the cutting unit 31 and the first moving unit 18. More specifically, dye-sublimation thermal printer 11 provides printed area 55 and non-printed area 56 on a portion to be cut off from a web of adhesive film, wherein the printing pattern is printed onto printed area 55 and the non-printed area 56 is not printed on, and wherein the dye-sublimation thermal printer 11 cuts off said portion and outputs the cut-off portion as a printed printing substrate, which in this example is a printed adhesive film 14.

In step 104, the printed adhesive film is transferred automatically from dye-sublimation thermal printer 11 to cutting apparatus 13 by means of transferring apparatus 12, and the second moving unit 16 of transferring apparatus 12 moves the printed adhesive film automatically in the forward direction from dye-sublimation thermal printer 11 to cutting apparatus 13. In step 105, cutting apparatus 13 cuts the adhesive film along the cutting pattern to produce the cut objects, and in step 106 the adhesive labels thus produced are outputted through output slot 7.

Input device 8 preferably provides a graphical user interface, which can be operated by the user by means of touch-sensitive monitor 3, for selecting desired colors, desired pattern templates, etc., and for entering desired texts. The adhesive label thus produced may be an adhesive label to be stuck onto a product to be bought, for example a shower gel container, muesli packaging, etc., in which case an adhesive label is produced which is suitable for the respective product, that is, for the respective product packaging. However, device 1 may also be adapted to produce adhesive labels which are not specifically matched to particular products or product containers. This means that device 1 may also be adapted to produce adhesive labels which are independent of specific products and which can be stuck onto cars or other objects, for example.

Device 1 allows personalized adhesive labels to be produced, that is, adhesive labels which have been designed by means of user inputs. In the embodiment described with reference to FIGS. 1 to 8, photo data receiving unit 5 is adapted to read photo data by means of a storage medium, for example, a USB flash drive. In other embodiments, however, the photo data receiving unit may also be adapted to receive the photo data in some another manner. For example, the photo data may be received directly from a camera via a wired or wireless data connection, in particular from a smartphone with a photo function. The photo data receiving unit may also be adapted to receive the photo data via cloud services such as Facebook, Dropbox, CEWE Cloud, etc.

The dye-sublimation thermal printer prints the respective pattern onto an adhesive film which is disposed on a substrate medium, for example a paper substrate, after which the printed adhesive film is transferred by means of the transferring apparatus to the cutting apparatus, which can also be conceived of as a sticker cutter. The orientation marking put on the adhesive film is detected by sensors, that is, by the detection unit of the cutting apparatus, and is used for re-adjusting the adhesive film, that is, for vertical and horizontal alignment of the adhesive film. In addition to the printed adhesive film, a digital clipping mask, that is, the cutting pattern, is sent to the cutting apparatus, said digital clipping mask representing the outlines of the adhesive label. The cutting unit of the cutting apparatus preferably comprises a drag knife, which is moved along the outline of the adhesive label, that is, along the cutting pattern, in order to cut into the adhesive film along the cutting pattern. The drag knife is preferably moved in such a way that only the adhesive film is incised, but not the substrate medium.

The cutting apparatus may be adapted to cut out any cutting patterns that are offered to the user in the form of templates, that is, in the form of the pattern templates, with the user being able to select any one of those templates. After cutting, the cutting apparatus outputs the adhesive label that has finally been produced. The adhesive label can be pulled off the substrate material by the user without any residue being left. If the user selected a product to which he would like to apply the cut object, the latter can now be stuck on by the user himself. Products obtainable in the drug store can thus be personalized in a simple manner by the user himself.

Although adhesive labels are produced as cut objects in the embodiments described above, other cut objects can be produced in other embodiments. For example, printing patterns can be printed onto a non-stick printing substrate, such as a non-stick paper substrate, after which the cut objects can be produced by cutting the non-stick printing substrate along the cutting pattern.

Although the pattern for producing the cut object is generated in the embodiments described above on the basis of user inputs, in order to produce personalized cut objects, a pattern can also be provided in a different way in other embodiments. For example, a predefined, non-personalized pattern can be used to generate the cut objects.

Although the printing substrate printed on and outputted by the dye-sublimation thermal printer in the embodiments described above is automatically transferred from the dye-sublimation thermal printer to the cutting apparatus by means of the transferring apparatus, this can also be done in a different way in other embodiments, for example manually. In the latter case, the device could have no transferring apparatus.

Although the dye-sublimation thermal printer in the embodiments described above is a component of the device for producing cut objects, the dye-sublimation thermal printer used within said device can also be used independently of said device. When also used in such a way, the printed area and the non-printed area can be either fixed and predefined, or variable, in which case the dimension of the non-printed area in the arrangement direction does not have to at least equal to a distance between the cutting unit and the first moving unit. The dimensions of the printed area and of the non-printed area, in particular in the arrangement direction, can be manually adjustable, in particular by means of a respective interface of the dye-sublimation thermal printer, or by a unit which controls the dye-sublimation thermal printer, in particular, that is, which controls at least the dimensions of the printed and non-printed areas.

In the claims, the words "comprise" and "include" do not exclude other elements or steps, and the indefinite article "a/an" does not exclude a plurality.

A single unit or device may perform the functions of several elements mentioned in the claims. The fact that individual functions and elements are mentioned in different dependent claims does not mean that a combination of these functions or elements could not also be used to advantage.

The controller of the device for producing cut objects in accordance with the method for producing cut objects can be implemented as computer program code and/or in the form of appropriate hardware and in particular is a programmable logic controller (PLC).

A computer program can be stored and/or distributed on a suitable non-transitory medium, for example on an optical storage medium or a solid-state storage medium which is operated in combination with or as part of other hardware. However, the computer program can also be distributed in other forms, for example via the Internet or other telecommunications systems.

The embodiments described herein relate to a device for producing cut objects. A dye-sublimation thermal printer prints a printing pattern onto a printing substrate and outputs the latter. A cutting apparatus then cuts the printing substrate along a cutting pattern, wherein the cutting apparatus comprises a cutting unit and a moving unit for moving the printing substrate during cutting. The dye-sublimation thermal printer is adapted to print the printing substrate in such a way that the outputted printing substrate has a printed area in which printing has occurred and a non-printed area in which printing has not occurred, wherein the printed area and the non-printed area are successively arranged and the dimension of the non-printed area in the arrangement direction is at least equal to a distance between the cutting unit and the first moving unit.

The invention claimed is:

1. A device for producing cut objects on the basis of a pattern that comprises a cutting pattern and a printing pattern within the cutting pattern, wherein the device comprises:

a dye-sublimation thermal printer for printing the pattern onto a printing substrate and for outputting the printed printing substrate and;

a cutting apparatus for cutting the printing substrate along the cutting pattern, wherein the cutting apparatus has a cutting unit for cutting the printing substrate and a first moving unit for moving the printing substrate within the cutting apparatus, wherein the first moving unit is adapted to move the printing substrate during the cutting process in a direction of movement from the first moving unit to the cutting unit and back from the cutting unit to the first moving unit, wherein the dye-sublimation thermal printer is adapted to print the printing substrate in such a way that the outputted printing substrate has a printed area in which printing has occurred and a non-printed area in which printing has not occurred, wherein the printed area and the non-printed area are successively arranged one after the other in an arrangement direction and the dimension of the non-printed area in the arrangement direction is at least equal to a distance between the cutting unit and the first moving unit, wherein the dye-sublimation thermal printer and the cutting apparatus are arranged in such a way that the direction of movement and the arrangement direction are aligned, and wherein the device also comprises:

a) a transferring apparatus for automatically transferring the printed printing substrate from the dye-sublimation thermal printer to the cutting apparatus, wherein the transferring apparatus comprises a second moving unit for automatically moving the printed printing substrate in a forward direction from the dye-sublimation thermal printer to the cutting apparatus, wherein the forward direction is aligned with the direction of movement and the arrangement direction, and b) a control apparatus for controlling at least the transferring apparatus and the cutting apparatus.

2. The device according to claim 1, wherein the dye-sublimation thermal printer, the transferring apparatus and the cutting apparatus are arranged in such a way that the printing substrate can be moved linearly in a forward direction from the dye-sublimation thermal printer to the cutting apparatus via the transferring apparatus, wherein the transferring apparatus is adapted to move the printed printing substrate in a forward direction by performing a translational movement only, without rotating the printing substrate.

3. The device according to claim 1, wherein the control apparatus is adapted to control the first and the second moving units in such a way that only the second moving unit is initially activated to move the printed printing substrate to the first moving unit, wherein both moving units are then activated in such a way that both moving units synchronously move the printed printing substrate further into the cutting apparatus.

4. The device according to claim 3, wherein the transferring apparatus further comprises a measurement unit for measuring the distance the printed printing substrate is moved in the direction of the cutting apparatus by means of the second moving unit, wherein the control apparatus is adapted to control the second moving unit in such a way that the printed printing substrate is moved forward in the direction of the cutting apparatus until the measured distance indicates that the printed printing substrate has been moved to the first moving unit.

5. The device according to claim 4, wherein the measurement unit is also adapted to measure the distance that the dye-sublimation thermal printer has guided the printed printing substrate into the transferring apparatus, wherein the control apparatus is adapted to control the second moving unit in such a way that the printed printing substrate is moved forwards in the direction of the cutting apparatus until the total measured distance indicates that the printed printing substrate has been moved to the first moving unit.

6. The device according to claim 5, wherein the second moving unit has motor-driven rolls that freewheel in a forward direction, wherein the measurement unit is adapted to measure a passive freewheeling rotation of the rolls when the printed printing substrate is moved from the dye-sublimation thermal printer into the transferring apparatus, in order to measure the distance that the dye-sublimation thermal printer has moved the printed printing substrate into the transferring apparatus.

7. The device according to claim 1, wherein the first moving unit comprises motor-driven rolls for moving the printed printing substrate in the cutting apparatus, wherein the motor-driven rolls do not freewheel.

8. The device according to claim 1, wherein the transferring apparatus comprises a guide unit which is adapted to guide the printed printing substrate past the second moving unit when the first moving unit moves the printed printing substrate backward in the direction of the transferring apparatus.

9. The device according to claim 8, wherein the guide unit is adapted to guide the printed printing substrate underneath the second moving unit when the first moving unit moves the printed printing substrate backward in the direction of the transferring apparatus.

10. The device according to claim 1, wherein the transferring apparatus has a printing substrate detection unit for detecting when the printed printing substrate is fed to the transferring apparatus, wherein the control apparatus is adapted to control the second moving unit in such a way that the second moving unit does not move the printed printing substrate in the direction of the cutting apparatus until a predefined period of time has expired since detection of the printing substrate being fed.

11. The device according to claim 1, wherein the second moving unit comprises motor-driven rolls for moving the printed adhesive film and which freewheel in the direction of the cutting apparatus.

12. The device according to claim 11, wherein the dye-sublimation thermal printer and the transferring apparatus are adapted in such a way that the printed printing substrate fed to the transferring apparatus from the dye-sublimation thermal printer rotates the freewheeling rolls of the second moving unit, wherein the printing substrate detection unit is adapted to detect when the printing substrate is fed, by detecting the rotation of the rolls of the second moving unit.

13. A method for producing cut objects on the basis of a pattern that comprises a cutting pattern and a printing pattern inside the cutting pattern, wherein the method comprises the steps of:

printing the printing pattern onto a printing substrate and outputting the printed printing substrate by means of a dye-sublimation thermal printer;

cutting the printing substrate along the cutting pattern by means of a cutting apparatus, wherein the cutting apparatus has a cutting unit for cutting the printing substrate and a first moving unit for moving the printing substrate within the cutting apparatus, wherein the first moving unit moves the printing substrate during a cutting operation into a direction of movement from the first moving unit to the cutting unit and/or back from the cutting unit to the first moving unit, wherein the dye-sublimation thermal printer prints the printing substrate in such a way that the output printing substrate comprises a printed area in which printing has occurred and a non-printed area in which printing has not occurred, wherein the printed area and the non-printed area are successively arranged in an arrangement direction and the dimension of the non-printed area in the arrangement direction is at least equal to a distance between the cutting unit and the first moving unit, and wherein the dye-sublimation thermal printer and the cutting apparatus are arranged such that the direction of movement during the cutting operation and the arrangement direction are aligned; and automatically transferring the printed printing substrate from the dye-sublimation thermal printer to the cutting apparatus using a transferring apparatus, the transferring apparatus comprising a second moving unit that automatically moves the printed printing substrate in a forward direction from the dye-sublimation thermal printer to the cutting apparatus, wherein the forward direction is aligned with the direction of movement and the arrangement direction, and wherein the transferring apparatus and the cutting apparatus are controlled by a control apparatus.

14. A non-transitory storage medium that stores a computer program for producing cut objects on the basis of a pattern that comprises a cutting pattern and a printing pattern within the cutting pattern, wherein the computer program contains program code which is adapted to control a device for producing cut objects according to claim 1 in such a way that a method for producing cut objects is carried out when the computer program is executed on a control apparatus which controls the device, wherein the method comprises the steps of:

printing the printing pattern onto a printing substrate and outputting the printed printing substrate by means of a dye-sublimation thermal printer; and cutting the printing substrate along the cutting pattern by means of a cutting apparatus, wherein the cutting apparatus has a cutting unit for cutting the printing substrate and a first moving unit for moving the printing substrate within the cutting apparatus, wherein the first moving unit moves the printing substrate during a cutting operation into a direction of movement from the first moving unit to the cutting unit and/or back from the cutting unit to the first moving unit, wherein the dye-sublimation thermal printer prints the printing substrate in such a way that the output printing substrate comprises a printed area in which printing has occurred and a non-printed area in which printing has not occurred, wherein the printed area and the non-printed area are successively arranged in the arrangement direction and the dimension of the non-printed area in the arrangement direction is at least equal to a distance between the cutting unit and the first moving unit.

* * * * *